United States Patent [19]

Andrea

[11] Patent Number: 4,796,937

[45] Date of Patent: Jan. 10, 1989

[54] INSULATING SHELL AND POURING AID FOR CONTAINER AND METHOD OF MAKING SAME

[76] Inventor: Douglas J. Andrea, 165 Brookville La., New York, N.Y. 11545

[21] Appl. No.: 106,227

[22] Filed: Oct. 6, 1987

[51] Int. Cl.[4] ..... B65D 25/18; B65D 81/38

[52] U.S. Cl. ..... 294/31.2; 220/85 H; 220/408; 220/903; 215/100 A

[58] Field of Search ..... 294/31.2; 215/100 A, 215/100 R, 12.2, 13.1, 100.5; 220/85 H, 903, 408, 412; 150/52 R

[56] References Cited

U.S. PATENT DOCUMENTS 2,745,569 5/1956 Seaman ..... 215/100 A 3,814,288 6/1974 Westrich ..... 215/13.1

4,268,567 5/1981 Harmony ..... 220/903

4,399,668 8/1983 Williamson ..... 220/903

*Primary Examiner*—James B. Marbert

*Attorney, Agent, or Firm*—Darby & Darby

[57] ABSTRACT

An insulating shell and carrier for a bottle in which the shell is formed of an insulating material having a main body section with an opening into which the bottle fits and an integral handle portion having an opening to permit a user to carry the bottle by the shell to use it as a pouring aid. The shell is preferably made from a flat sheet of material which is cut to the desired shape and size and joined at the edges to form the configuration matching that of the bottle.

8 Claims, 2 Drawing Sheets

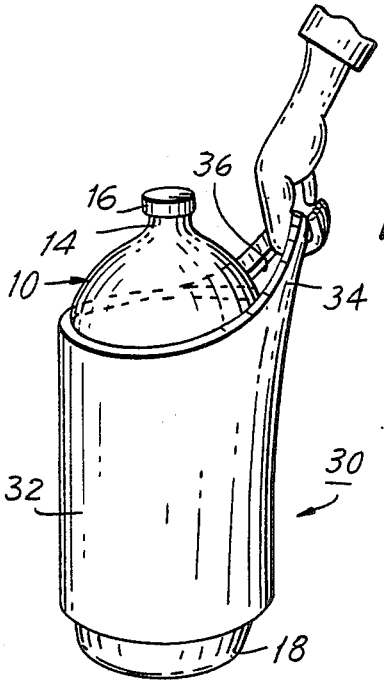
FIG. 4
FIG. 5
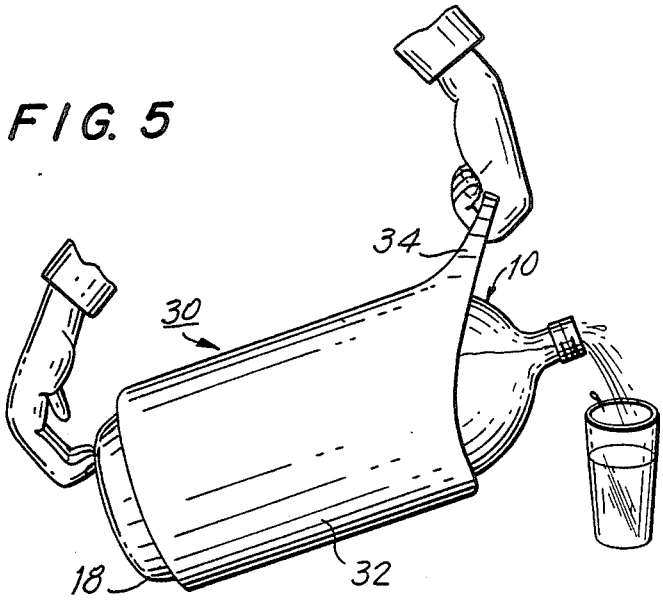

INSULATING SHELL AND POURING AID FOR CONTAINER AND METHOD OF MAKING SAME

BACKGROUND OF THE INVENTION

Plastic and glass bottles for holding various types of beverages, for example carbonated softdrinks, are widely used. Such bottles come in a variety of sizes, for example, one quart and two liter. Especially with bottles having a large surface area, such as the two or three liter size, when exposed to the ambient environment of a room, or for example when outdoors such as at a picnic location, the contents of the bottle if originally cold, tend to heat up relatively quickly. Accordingly, a need exists for a way to insulate the bottles to prevent the contents from becoming warm.

In addition, especially with larger size bottles, it is somewhat difficult to carry them and, also, to manipulate the bottles to pour out the contents without spilling. This is particularly true where the bottle is full.

BRIEF DESCRIPTION OF THE INVENTION

The present invention relates to a unique insulating shell for such a bottle which also has the capability of aiding in the carrying of the bottle and also in pouring of its contents. In accordance with the invention, the shell is formed of insulating material, for example, a foam type plastic, in the general shape of a cylinder of the size to form a tight engaging fit with the bottle. The insulating shell has an integral portion which extends upwardly from the main cylindrical insulating section and is formed with an opening as a carrying handle. A user can carry the bottle and its contents by holding the handle. Also, by holding the bottle by the carrying handle with one hand and holding the bottom of the bottle with the other hand, particularly where it has an indented lower surface, it is easy to pour out the contents to the desired location.

OBJECTS OF THE INVENTION

It is therefore an object of the present invention to provide an insulating shell for a bottle having a close conforming fit to achieve good insulation of the bottle contents.

Another object is to provide an insulating shell for a bottle in which the shell has an upwardly extending portion which can serve as a carrying handle.

An additional object is to provide an insulating shell for a container from a material having high insulating characteristics which can be readily collapsed for ease of shipment.

Another object is to provide an insulating shell for a bottle, with the shell having an integral upwardly extending part serving as a handle for carrying the bottle and/or an aid in pouring out its contents.

BRIEF DESCRIPTION OF THE DRAWINGS

Other objects and advantages of the present invention will become more apparent upon reference to the following specification and annexed drawings in which:

FIG. 4 is a perspective view of the shell attached to the bottle and being used for carrying the bottle; and FIG. 5 is a perspective view of the shell attached to the bottle and being used as a pouring aid.

DETAILED DESCRIPTION OF THE INVENTION

Figure 1:
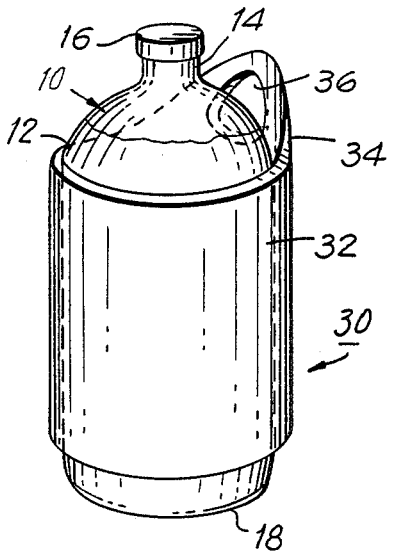
FIG. 1 is a perspective view of the container with the insulating shell attached.

Referring to the drawings, FIG. 1 shows a typical plastic container 10 of conventional construction which is made by any suitable process, e.g., blow molding, etc. The container and the method of manufacture form no part of the present invention. The container is, for example, of one quart or two or three liter size.

The container 10 has the usual cylindrical major body portion 12 for holding the liquid contents, often under pressure of carbonation, a neck portion 14 which has a threaded upper end on which a closure 16 is secured. In its original condition, the closure is often sealed to the body by a tamper proof ring. At the bottom of the container 10 there is usually a plastic reinforcing collar 18. The bottom end of the container is also usually formed with an indented ring (not shown), this ring being used for structural purposes. Again, none of these features of the bottle are part of the present invention.

The insulating shell 30 of the present invention has a central section 32 which is of shape and size conforming to that of the major portion 12 of the bottle. Integral with the shell central section 32 is an upwardly extending carrying handle extension 34 which has an opening 36 therein of a size, for example, so that a hand can fit.

Figure 2:
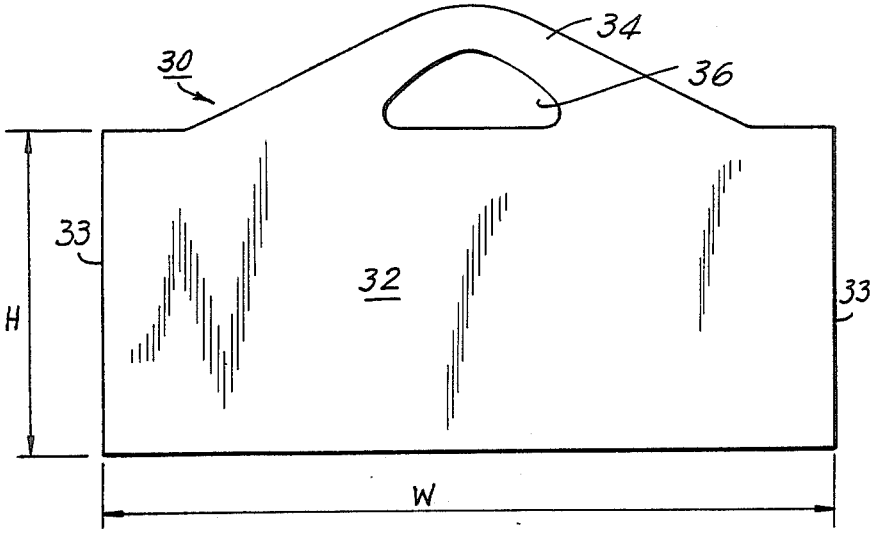
FIG. 2 is a plan view of the shell.

As seen more clearly in FIG. 2, the insulating shell 30 is formed from a flat piece of material, for example foam rubber, foam plastic, etc. Once suitable material has been found to be VOLARA of a thickness in the range of from about $\frac{3}{8}$ inches to $\frac{1}{2}$ inch thick. It has been found that a thickness of this dimension satisfies the insulating requirements as well as the strength requirements for carrying the bottle by carrying handle 34 when full with its contents.

Such insulating materials are generally sold in roll form and, in accordance with the invention, a piece of material of a suitable overall size, such as shown in FIG. 2, is cut to the desired shape and size to form the shell after it has been unrolled. As seen in FIG. 2, the width W off the central section 32 when flat is equal to that necessary to form a cylinder when rolled having a diameter which is slightly greater than the outer diameter of the bottle 10 over which the shell is to be slipped. The height H of the shell central section is selected preferably to be substantially equal to the height of the main body portion 12 of the container above the plastic reinforcing collar 18 up to a point on the top of the bottle where it starts to narrow down into the neck. Of course, the height can be selected as desired but the greater the height, the greater will be the insulating effect of the shell.

The extending handle portion 34 is integral with the sheet 32. It has a height which extends to, for example, slightly lower than the top 16 of the bottle after the shell has been slipped over the bottle and located at its desired location. The height extension of the handle 34 is a matter of choice. The width of the handle portion 34, where it extends from the main section 32, should be wide enough to provide the necessary strength. That is, the handle should not tear or rip away from the central section when a full bottle is picked up by the handle. Generally, if the handle extends from a taper at its base where it joins the central section of the shell by about 270°, this will be adequate. As shown in FIG. 2, the handle extension structural 34, tapers upwardly from the base toward the top. This provides the necessary strength for the handle. Similarly, the handle opening 36 should be far enough down from the top of the handle extension and those should be enough shell material at each end of the handle opening 36 so that the shell will not tear at the opening 36. If desired, there can be a reinforcing member such as a tape or molding (not shown) around the inside of the handle opening 36. It should be understood that the exact dimensions of the height of the shell and the height of the handle carrying portion can be selected as desired.

Figure 3:
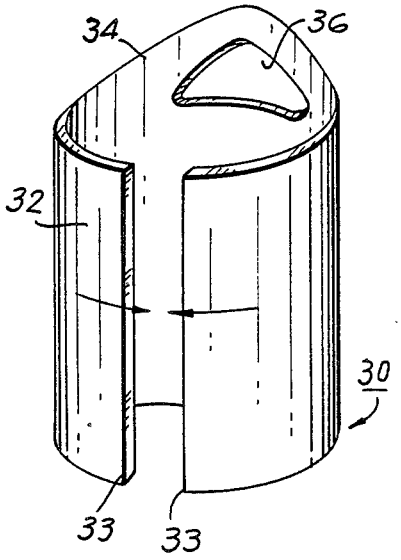
FIG. 3 is a perspective view of the shell shown detached from the bottle.

After the sheet 32 has been cut to the desired shape, it is rolled into the general cylinder form shown as shown in FIG. 3. The edges 33 of the sheet are sealed together to form a complete cylinder. The sealing can be accomplished any of a number of ways, for example, by a strip of adhesive sealing tape, by using a suitable adhesive and joining the edges end-to-end with adhesive, use of heat welding, ultra-sonic welding, etc. It is preferred that when the sheet 32 is cut, that each of the edges 40 which are abutted and joined together be angled in opposite directions so that upon rolling the sheet into the cylinder form there will be butt edges which will seal properly and smoothly in the cylindrical configuration. This also provides the maximum surface area for joining the edges.

FIGS. 1, 4 and 5 shows the finished form of the shell. As seen, with the flat sheet rolled into the cylindrical shape that the carrying handle 34 also assumes a curved shape.

Since the shell is made of a flexible foam rubber/plastic type of material, it can be flattened to be placed in a box or bag for shipment and/or display. This can be done without destroying the seal on the edges 33. Alternatively, the shell can be shipped without the edges being sealed to each other and the customer provided with a tube of adhesive and/or piece of sealing tape so as to take the flattened sheet and to assemble it into the final cylindrical shape.

In using the insulating shell, the bottle 10 is slipped into the shell opening and it is positioned preferably so that the shell's main body section 32 fits over the main body portion of the container 10.

As shown in FIG. 4, the handle is available to be grasped by the user. The user can pick-up the bottle by the handle by placing his hand in the opening 36. As pointed out above, the shell material is selected to have adequate strength properties to permit this.

The shell also can be used to aid the user in pouring the contents from the bottle. Referring to FIG. 5, as shown the user has one hand in the opening 36. The user lifts the bottle by the handle and grasps the bottom of the bottle by putting his fingers into the indent. The user now has two points of contact with the bottle, one at the bottom and the other spaced away from the top of the bottle. This provides a very effective and convenient pouring arrangement.

The insulating properties of the shell, when selected to be thick enough, are quite advantageous. With the VOLARA material referred to above in a ⅜ inch thickness, it has been found that a 2 liter bottle with cold contents exposed to room temperature maintains its temperature for a period of several hours. This is in addition to the advantage of having the handle for use in carrying and pouring.

While the shell has been shown of generally cylindrical shape, it should be understood that other shapes can be made. For example, a bottle of three or four, or more, flat sides, the central section 32 of the shell sheet can be formed with folding lines, or made of separate pieces of material, each corresponding to one of the sides of the bottle, where separate pieces are used, these can be joined together in the manner previously described.

While the shell is described in the preferred embodiment as being made from a flat sheet of material, it should b understood that if insulating material always formed in a tubular shape is available, that it then is necessary only to cut a piece of the tubular material to the desired length and thereafter shape the handle 34 and form its opening 36.

I claim:

1. An insulating shell for a container having a main body portion with an outer surface configuration comprising:

a shell of insulating material formed of a shape to define a central opening corresponding to the outer surface configuration of the container main body portion;

said shell having a central portion to encompass a substantial part of the main body portion of the container to insulate the container contents, and an integral handle portion formed in the shell extending from and along the shell central portion and having an opening therein with at least a part of said opening adapted to extend above the container central body portion.

2. An insulating shell as in claim 1 wherein the material is a type of foam rubber or foam plastic.

3. An insulating shell as in claim 1 adapted for use on a bottle container having a neck which tapers upwardly from the main body portion of the bottle, wherein the opening in the shell handle portion when the shell is attached to the bottle has a portion which is substantially as high as the tapered bottle neck.

4. An insulating shell as in claim 3 wherein the shell handle portion occupies only a part of the shell central portion and has a base which is integral with a part of the top of the shell central section, and tapers inwardly toward the top of the handle.

5. An insulating shell as in claim 1 wherein said shell is formed from a flat sheet of material with the edges joined together.

6. An insulating shell as in claim 4 wherein the shape of the shell central portion is generally cylindrical and said shell handle portion resides in only a part of generally cylindrical shape of the shell.

7. An insulating shell as in claim 1 wherein the shape of the shell central portion is generally cylindrical and said shell handle portion resides in only a part of generally cylindrical shape of the shell.

8. A method of making an insulating shell for a container comprising the steps of:

providing a flat sheet of an insulating material;

cutting the sheet to form a central section having width and height dimensions such that when the ends of the width of the sheet are abutted end-to-end they form an opening corresponding to the outer diameter and height of the main body portion of a container over which the shell is to be placed, forming the sheet with a one piece integral handle portion extending above the height dimension of the central section of the sheet, forming an opening in the handle portion to accept a part of a human hand, and fastening the ends of the central section together.

* * * * *